US009801774B2

(12) United States Patent
Noel

(10) Patent No.: US 9,801,774 B2
(45) Date of Patent: Oct. 31, 2017

(54) SPINAL DECOMPRESSION BELT FOR USE WITH INVERSION TABLE

(71) Applicant: Cedrick Noel, Woodstock, GA (US)

(72) Inventor: Cedrick Noel, Woodstock, GA (US)

( * ) Notice: Subject to any disclaimer, the term of this patent is extended or adjusted under 35 U.S.C. 154(b) by 255 days.

(21) Appl. No.: 14/615,066

(22) Filed: Feb. 5, 2015

(65) Prior Publication Data

US 2015/0305962 A1 Oct. 29, 2015

Related U.S. Application Data

(60) Provisional application No. 61/984,200, filed on Apr. 25, 2014.

(51) Int. Cl.
*A61H 1/02* (2006.01)

(52) U.S. Cl.
CPC ..... *A61H 1/0292* (2013.01); *A61H 1/0222* (2013.01); *A61H 1/0229* (2013.01); *A61H 2201/1284* (2013.01); *A61H 2201/163* (2013.01); *A61H 2201/1642* (2013.01); *A61H 2203/0493* (2013.01)

(58) Field of Classification Search
CPC .. A61H 1/0218; A61H 1/0292; A61H 1/0229; A61H 2201/1607; A61H 2201/1284; A61H 2201/163; A61H 2201/1642; A61H 2203/0493; A61F 5/04
See application file for complete search history.

(56) References Cited

U.S. PATENT DOCUMENTS

| | | | | |
|---|---|---|---|---|
| 3,561,434 | A * | 2/1971 | Kilbey | A61F 5/24 602/36 |
| 5,772,622 | A | 6/1998 | Friske | |
| 6,464,296 | B1 | 10/2002 | Sumner | |
| 7,282,039 | B2 | 10/2007 | Henke | |
| 7,887,499 | B2 * | 2/2011 | Cogswell | A61F 5/3715 602/23 |
| 2003/0195092 | A1 * | 10/2003 | Basting | A63B 21/0552 482/124 |
| 2006/0178607 | A1 | 8/2006 | Evans | |
| 2013/0059705 | A1 | 3/2013 | Leier et al. | |

* cited by examiner

*Primary Examiner* — Ophelia A Hawthorne
(74) *Attorney, Agent, or Firm* — Global Intellectual Property Agency, LLC; Daniel Enea

(57) ABSTRACT

A spinal decompression belt for reducing the pressure exerted on a user's ankles when using an inversion table. The spinal decompression belt includes an elongated pad to be disposed around a user's abdomen and that can be secured by overlapping the end portions thereof. A cushioning member is removably securable to the interior of the first end for providing additional support to the user's abdomen. The elongated pad further includes an elongated strap therearound that includes an adjustable fastener for securing the belt to the user. An extension strap having an adjustable fastener thereon extends from the front of the elongated pad to the rear thereof and can be positioned between the legs of the user. The extension strap further includes a fastener, such as a ring, having a pair of ankle bar straps thereon that can be wrapped around the ankle bars of an inversion table.

9 Claims, 3 Drawing Sheets

SPINAL DECOMPRESSION BELT FOR USE WITH INVERSION TABLE

CROSS REFERENCE TO RELATED APPLICATION

This application claims the benefit of U.S. Provisional Application No. 61/984,200 filed on Apr. 25, 2014. The above identified patent application is herein incorporated by reference in its entirety to provide continuity of disclosure.

BACKGROUND OF THE INVENTION

Field of the Invention

The present invention relates to spinal decompression devices. More specifically, the present invention provides a spinal decompression belt adapted to be worn around the waist of a user and that includes ankle bar straps thereon for securement to the ankle bars of an inversion table.

Many people suffer from chronic back pain resulting from spinal problems such as pinched nerves, disc bulge, disc herniation, spinal stenosis, and sciatica, among others. Spinal decompression techniques may be used to relieve pressure on the nerves of the spinal column and can be achieved surgically and non-surgically. Surgical techniques can be invasive and can require injections and anesthesia. Thus, the pain and invasiveness of surgical techniques may be unappealing for many people. Further, surgical techniques can be prohibitively expensive and may not be viable treatment options for those with limited financial means.

Non-surgical spinal decompression techniques can be used to avoid the pain and expense of surgical operations. Inversion therapy is a common technique wherein a user is positioned upside-down or at an inverted angle to relieve stress on the spinal column. Decompression or inversion tables include a frame having a table pivotally secured thereto. A person can lie on the table and the table can be rotated so as to dispose the person at an angled or inverted position for the purpose of relieving pressure on the spine.

When positioned on an inversion table, ankle bars or supports are provided for helping to suspend the person in an inverted position. As a result, the person may feel pressure on his or her ankles as the person's ankles are supporting much of the person's body weight. Thus, a device that helps to support a user in an inverted position on an inversion table that helps to reduce pressure on the user's ankles is desired.

Description of the Prior Art

Devices have been disclosed in the prior art that relate to devices for relieving back pressure. These include devices that have been patented and published in patent application publications. These devices generally relate to inversion tables and devices for reducing pressure on a user's back. The following is a list of devices deemed most relevant to the present disclosure, which are herein described for the purposes of highlighting and differentiating the unique aspects of the present invention, and further highlighting the drawbacks existing in the prior art.

One such device, U.S. Pat. No. 5,772,622 to Friske discloses a gravity inversion belt. The device comprises a belt to be secured around the waist of the user and having straps thereon for securement to a support surface. The straps are connected by an apron that limits rotation of the user. The user can wear the belt and can tilt into an inverted position and the apron will limit the movement of the user. Thus, Friske does not disclose a device comprising a belt having straps securable to the ankle supports of an inversion table for reducing stress on a user's ankles.

Another device, U.S. Published Patent Application Number 2006/0178607 to Evans discloses a back pressure relief device. The device comprises a waist belt, a plurality of tension lines extending along the legs of the user, and a mechanism to attach the tension lines to a support surface in order to provide tension. In this way, a user can lie in a reclined position and the device provides tension on the belt to help relieve back pressure. Thus, Evans fails to disclose a device for use with an inversion table comprising straps securable to the ankle supports of the inversion table.

U.S. Pat. No. 6,464,296 to Summer discloses a therapeutic inversion chair. The device includes a chair that is pivotally supported on a horizontal axis between positions of varying inclination. A stop is mounted on the chair for restricting rearward movement of the chair. The chair may including means for biasing the chair in an upright position. Thus, Summer does not disclose a spinal decompression belt, but instead discloses a chair adapted to be pivoted into various inclined positions.

U.S. Pat. No. 7,282,039 to Henke discloses a device for allowing a user to administer lumbar traction in a supine position on a support. The device includes an upper body harness adapted to encircle the user's torso that is anchored to a support near the user's head. A lower body harness encircles the user's waist and is anchored to a support near the user's feet. Elastic tensioning members extend from the lower body harness to the support to which it is anchored. Thus, Henke fails to disclose a spinal decompression belt for use with an inversion table.

U.S. Published Patent Application Number 2013/0059705 to Leier et al. discloses a tilting inversion exerciser. The device includes a carrier for supporting a table pivotally secured to a support stand. A support member is engaged with the table and curves upwardly from the table for engaging with a waist portion of the user. The support members include a latch extending from each side thereof for engaging with the supporting table and for anchoring the support member to the table. Thus, Leier discloses a tilting inversion exercise and fails to disclose a spinal decompression belt to be disposed around a user's waist when used with a conventional inversion table.

These prior art devices have several known drawbacks. The devices in the prior art generally relate to inversion devices that can be inclined in various positions. However, such devices require the use of a specific inversion table or similar device, which does not allow a user to use a conventional inversion table. Further, such devices do not provide means for reducing the pressure on a user's ankles when using an inversion table. The present invention provides a spinal decompression belt that includes ankle straps that can be secured to the ankle bars of the inversion table in order to help support the user's weight in order to reduce pressure on the ankles.

In light of the devices disclosed in the prior art, it is submitted that the present invention substantially diverges in design elements from the prior art and consequently it is clear that there is a need in the art for an improvement to existing spinal decompression devices. In this regard the instant invention substantially fulfills these needs.

SUMMARY OF THE INVENTION

In view of the foregoing disadvantages inherent in the known types of spinal decompression belts now present in the prior art, the present invention provides a new spinal decompression belt wherein the same can be utilized for providing convenience for the user when decompressing the user's spine using an inversion table.

It is therefore an object of the present invention to provide a new and improved spinal decompression belt device that has all of the advantages of the prior art and none of the disadvantages.

It is another object of the present invention to provide a spinal decompression belt device comprising an elongated pad adjustably and removably securable around a user's waist.

Another object of the present invention is to provide a spinal decompression belt device comprising a pair of ankle bar straps that can be disposed around the ankle bars of an inversion table in order to help to support the user's weight.

Yet another object of the present invention is to provide a spinal decompression belt device comprising adjustable fasteners thereon for adjusting the length of each strap and for adjusting the fit of the device on the user.

Another object of the present invention is to provide a spinal decompression belt device that may be readily fabricated from materials that permit relative economy and are commensurate with durability.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
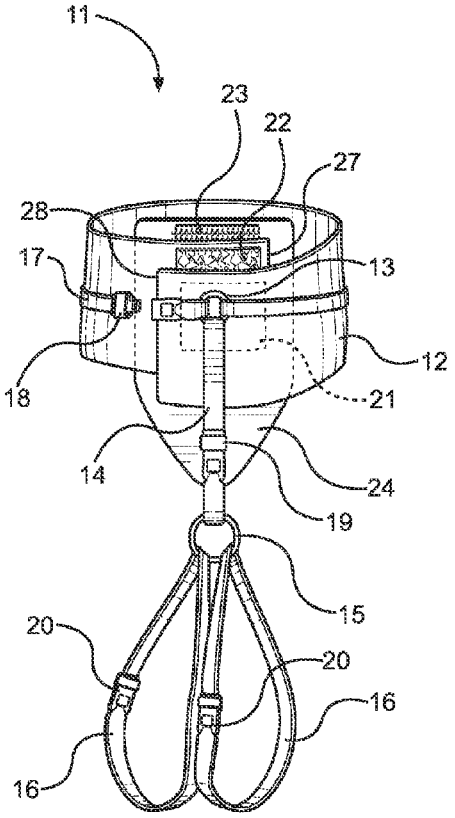
FIG. 1 shows a front perspective view of the spinal decompression belt of the present invention.

Reference is made herein to the attached drawings. Like reference numerals are used throughout the drawings to depict like or similar elements of the spinal decompression belt of the present invention. For the purposes of presenting a brief and clear description of the present invention, the preferred embodiment will be discussed as used for relieving pressure on a user's spine to help lessen back pain. The figures are intended for representative purposes only and should not be considered to be limiting in any respect.

Figure 2:
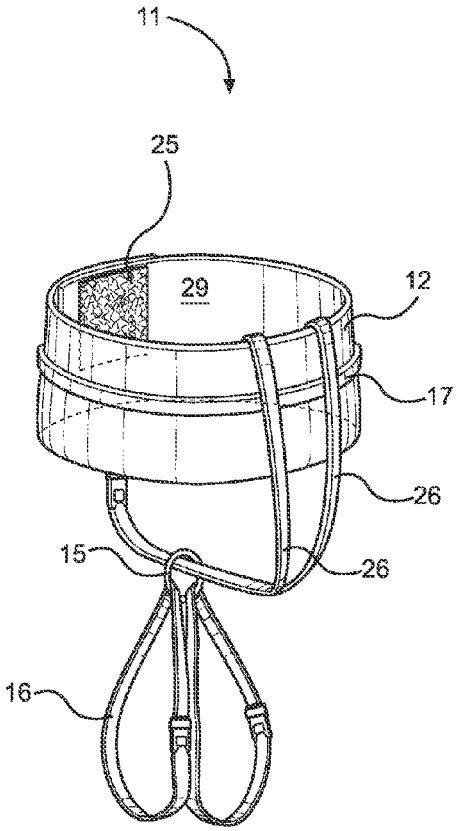
FIG. 2 shows a side perspective view of the spinal decompression belt of the present invention.

Referring now to FIGS. 1 and 2, there are shown front perspective views of the spinal decompression belt of the present invention. The spinal decompression belt of the present invention provides an elongated pad 12 having a first end 27 and a second end 28. The elongated pad 12 is preferably composed of a durable, flexible material. The first end 27 includes a fastener 22 thereon that is adapted to engage with a fastener 21 on the second end 28 of the elongated pad 12 when the first end 27 and second end 28 are placed in an overlapping relation. This allows the user to easily adjust the size of the pad 12 to fit users of various sizes. The fasteners 21, 22 preferably comprise hook and loop fastening material, however, the fasteners 21, 22 may alternately include various other types of fasteners such as snaps or buttons, among others.

A cushioning member 24 is removably securable to the interior surface of the first end 27 of the elongated pad 12. The interior surface of the first end 27 includes a fastener 25 thereon, such as hook and loop fastening material. The fastener 25 is adapted to engage with a fastener 23 on the cushioning member so that the cushioning member 24 can be removably secured to the elongated pad 12. The cushioning member 24 preferably comprises a soft, padded material to provide comfort to the user when the user is wearing the spinal decompression belt 11 of the present invention. Preferably, the cushioning member 24 comprises a shield-like configuration so that the lower end thereof extends below the elongated pad 12, so as to cover a front portion of the user's legs. This helps to prevent any straps of the invention from pressing into the user's legs.

The pad 12 includes an elongated strap 17 thereon. The elongated strap 17 is disposed on the exterior of the pad 12 and forms a loop. The elongated strap 17 includes an adjustable fastener thereon 18, such as a buckle having male and female engaging portions. The strap 17 provides additional securement of the elongated pad 12 to the user so that device remains in position while in use. The adjustable fastener 18 allows the user to tighten the device so that it fits snugly and securely around the user's lower abdomen or torso.

The front portion of the pad 12 includes a ring 13 thereon. The elongated strap 17 is preferably secured at each end to the ring 13. An extension strap 14 includes a first end and a second end, wherein the first end is secured to the ring 13 on the pad 12, while the second end is secured to a rear portion of the pad 12. Thus, the extension strap 14 extends from the front of the pad 12 to the rear of the pad 12 and is substantially perpendicular to the elongated strap 17. The extension strap 14 includes an adjustable fastener 19 thereon, such as a buckle with removably engaging male and female portions. The adjustable fastener 19 allows the user to lengthen or shorten the extension strap 14.

The extension strap 14 preferably comprises a pair of straps 26 at the second end thereof. In the illustrated embodiment, the pair of straps 26 is spaced from one another and each strap is secured at a rear portion of the elongated pad 12. Preferably, the pair of straps 26 is secured at the upper portion of the rear of the elongated pad 12 and may wrap around the upper end thereof so as to provide a secure attachment. The straps 26 can be secured via stitching or adhesives, among other fasteners. Thus, the extension strap 14 is shown as having a Y-configuration. In operation, the extension strap 14 passes from the front of the user through the area between the user's legs, and is secured to rear portion of the elongated pad 12.

A lower ring 15 is positioned on the extension strap 14, preferably towards the front portion thereof, and includes a pair of ankle bar straps 16 thereon. The ankle bar straps 16 comprise elongated straps formed into loops. The ankle bar straps 16 are substantially the same shape and dimension. Each ankle bar strap 16 includes an adjustable fastener 20 thereon for adjusting the length thereof. The adjustable fastener 20 preferably comprises a buckle having male and female engaging portions. The ankle bar straps 16 can be wrapped around the ankle bars of an inversion table without the use of any additional fasteners.

Figure 3:
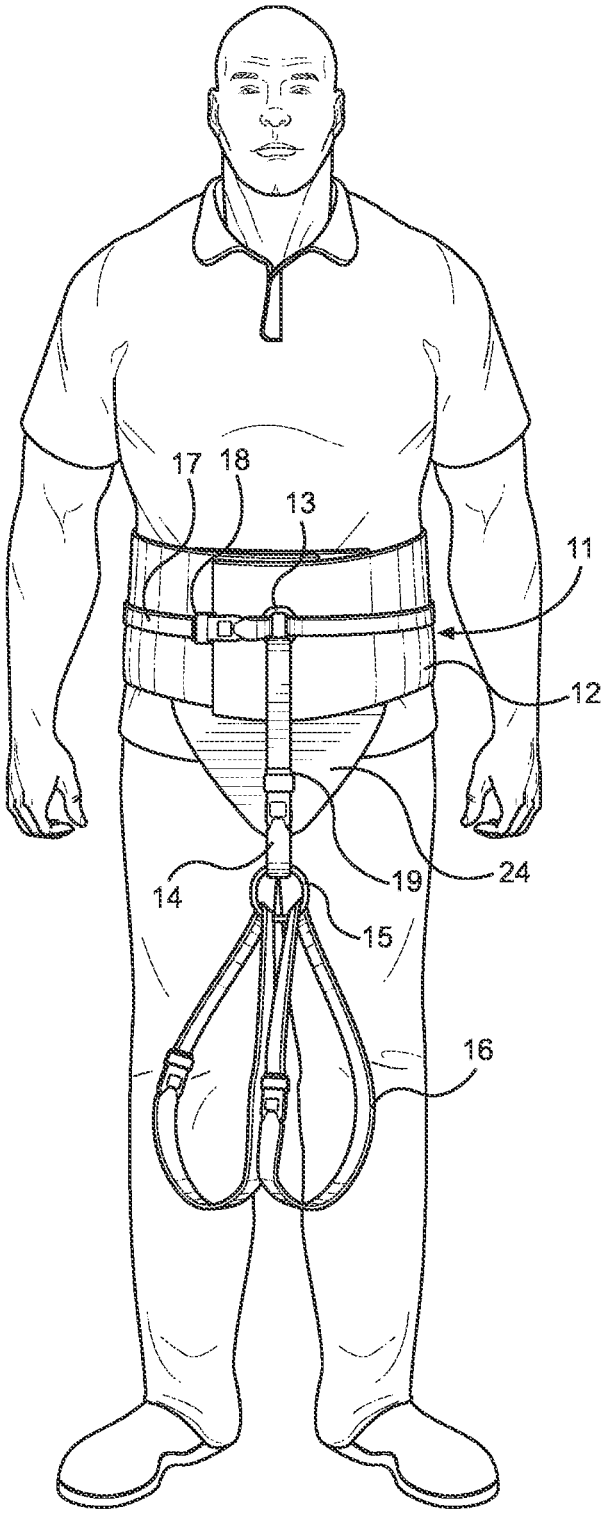
FIG. 3 shows a perspective view of the spinal decompression belt of the present invention as worn by a user.

Referring now to FIG. 3, there is shown a perspective view of a user wearing the spinal decompression belt of the present invention. In operation, the user can wrap the elongated pad 12 around his or her lower abdomen or torso and secure the elongated pad by overlapping the first and second ends and securing the fasteners thereon. Further, the user can optionally secure the cushioning member 24 on the interior of the first end of the elongated pad 12 so that it rests against the front of the user. The user can then secure the elongated strap 17 using the fastener 18 thereon so as to secure the device in place. The user can then adjust the extension strap 14 and the ankle bar straps 16 using the adjustable fasteners thereon, respectively so that the ankle bar straps 16 can be wrapped around the ankle bars.

Figure 4:
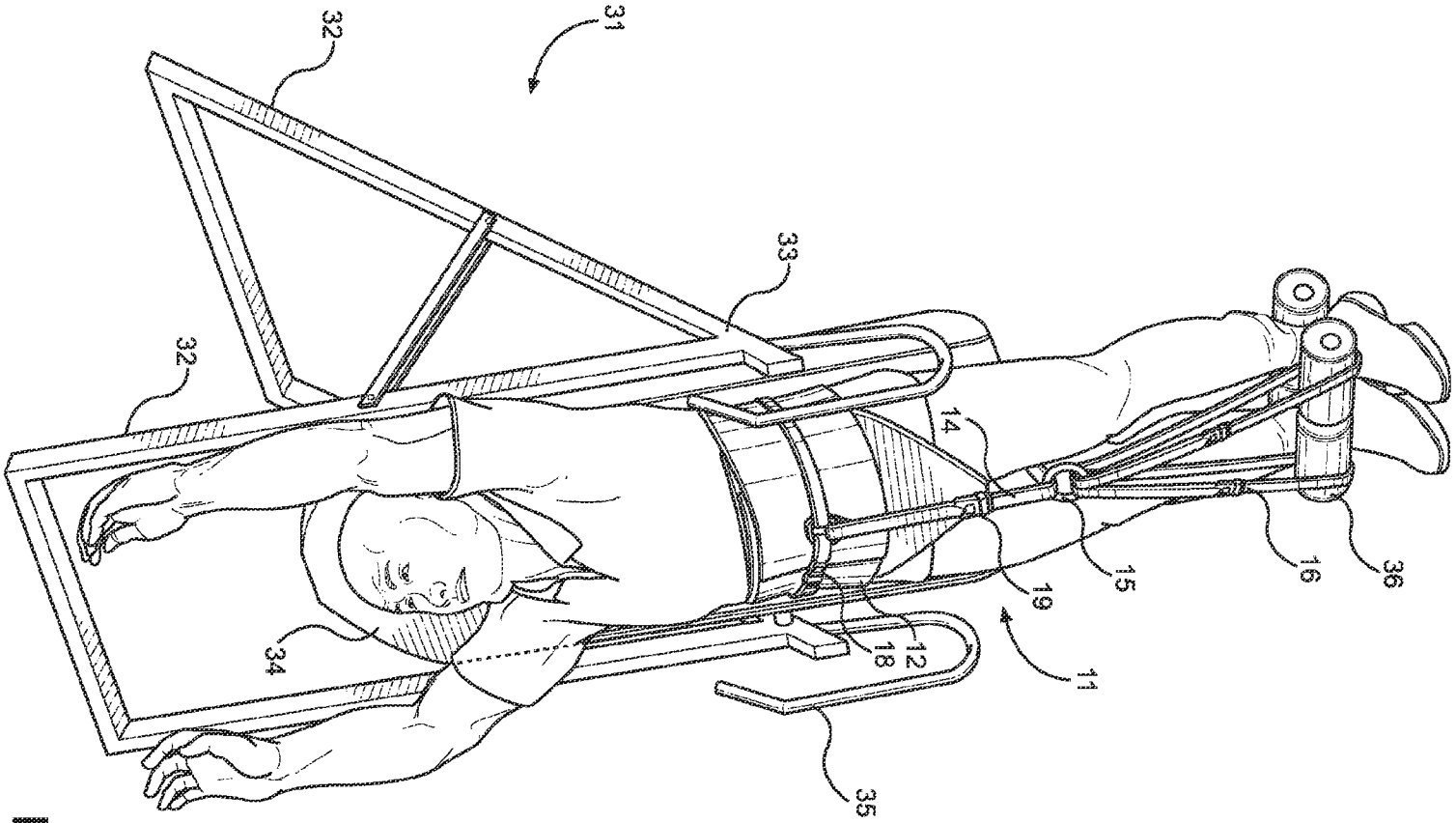
FIG. 4 shows a perspective view of a user on an inversion table wearing the spinal decompression belt.

Referring now to FIG. 4, there is shown a perspective view of a user on an inversion table wearing the spinal decompression belt. An inversion table comprises a pair of rectangular frame members 32 secured together at an upper end 33 thereof. In this way, the frame members 32 form a triangular frame. The upper end 33 of the frame may also include handlebars 35 thereon. The triangular frame rotatably supports a table 34 thereon. The table 34 is rotatable about a horizontal axle supported on the upper end 33 of the frame. The table 34 comprises a flat, planar surface on which a user can lie. The lower end of the table 34 includes ankle bars 36 thereon in which a user can position his or her feet so that the user can remain on the table 34 while inverted.

In operation, the user can secure the spinal decompression belt 11 to his abdomen and adjust the elongated strap 17 thereon for a secure and tight fit. The user can then lie on the table 34 with his or her back against the table 34. The user positions his or her feet on the ankle bars 36 on the lower end of the inversion table 34. However, this places considerable pressure on the user's ankles while he or she is inverted. To better distribute the user's weight in order to relieve some of the pressure on the user's ankles, the user can secure the ankle bar straps 16 to the ankle bars 36 of the inversion table 31 by disposing the loops around the ankle bars 36. The securement of the ankle bar straps 16 on the ankle bars 36 helps to support the user's weight and reduces the pressure on the user's ankles.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A spinal decompression belt for use with an inversion table, comprising:

an elongated pad having a first end and a second end adapted to encircle a user's abdomen; wherein said first end includes a fastener thereon and said second end includes a fastener thereon, wherein said first end and said second end can be secured in an overlapping configuration by engaging said fasteners thereon;

an elongated strap disposed around said elongated pad, said elongated strap having an adjustable fastener thereon;

an extension strap having a first end secured to a front portion of said elongated pad, and a second end secured to a rear portion of said elongated pad;

a pair of ankle bar straps connected to said extension strap, said pair of ankle support straps adapted to be removably secured to ankle bars of an inversion table;

a lower ring configured to move along said extension strap.

2. The spinal decompression belt of claim 1, further comprising a cushioning member removably securable to said elongated pad.

3. The spinal decompression belt of claim 2, wherein said cushioning member includes hook and loop fastening material thereon adapted to engage with a hook and loop fastening material disposed on an interior surface of said elongated pad.

4. The spinal decompression belt of claim 1, wherein said fastener on said first end of said elongated pad comprises hook and loop fastening material, and wherein said fastener on said second end of said elongated pad comprises hook and loop fastening material.

5. The spinal decompression belt of claim 1, wherein said extension strap includes an adjustable fastener thereon.

6. The spinal decompression belt of claim 1, wherein said pair of ankle bar straps comprises loops that are adapted to be removably positioned over the ankle bars of said inversion table.

7. The spinal decompression belt of claim 1, wherein said pair of ankle bar straps comprise adjustable fasteners thereon.

8. The spinal decompression belt of claim 1, wherein said second end of said extension strap includes a pair of straps, wherein each of said pair of straps is affixed to said rear portion of said elongated pad.

9. The spinal decompression belt of claim 1, wherein said pair of ankle bar straps are directly attached to said lower ring.

* * * * *